US006247858B1

(12) United States Patent
Dubon

(10) Patent No.: US 6,247,858 B1
(45) Date of Patent: Jun. 19, 2001

(54) X-RAY FILM PROCESSOR

(75) Inventor: William Dubon, Villa Park, IL (US)

(73) Assignee: Fischer Industries, Inc., Geneva, IL (US)

( * ) Notice: Subject to any disclaimer, the term of this patent is extended or adjusted under 35 U.S.C. 154(b) by 0 days.

(21) Appl. No.: 09/452,312

(22) Filed: Dec. 1, 1999

Related U.S. Application Data

(60) Provisional application No. 60/110,456, filed on Dec. 1, 1998.

(51) Int. Cl.[7] ..... G03D 7/00
(52) U.S. Cl. ..... 396/579; 34/401
(58) Field of Search ..... 396/579; 34/60, 34/164, 401, 426; 219/216

(56) References Cited

U.S. PATENT DOCUMENTS

| | | | |
|---|---|---|---|
| 4,086,607 | 4/1978 | Muller | 396/572 |
| 4,316,663 | 2/1982 | Fischer | 392/622 |
| 5,040,012 | 8/1991 | Eklund et al. | 396/620 |
| 5,105,557 * | 4/1992 | Vadasz et al. | 34/401 |
| 5,754,208 * | 5/1998 | Szlucha | 347/102 |
| 5,805,949 * | 9/1998 | Nozawa et al. | 396/612 |

FOREIGN PATENT DOCUMENTS

| | | |
|---|---|---|
| 3-036034 * | 2/1991 | (JP) . |
| 4-157789 * | 5/1992 | (JP) . |
| 10-274475 * | 10/1998 | (JP) . |

* cited by examiner

*Primary Examiner*—D. Rutledge
(74) *Attorney, Agent, or Firm*—Polster, Lieder, Woodruff & Lucchesi, L.C.

(57) ABSTRACT

An improved drying chamber, which in the preferred embodiment is employed with an x-ray film processor, includes an infrared heater source. Preferably the infrared source is positioned to dry respective first and second sides of a material requiring drying, for example x-ray film. The infrared source includes a control circuit for driving the infrared source. The frequency at which the infrared source operates is chosen so as to cause fluid particles being dried to resonate, permitting a more efficient heating cycle. In an x-ray film process, this allows a smaller and faster operating unit to be provided

17 Claims, 1 Drawing Sheet

X-RAY FILM PROCESSOR

CROSS-REFERENCE TO RELATED APPLICATIONS

This application claims priority to provisional application Ser. No. 60/110,456, filed Dec. 1, 1998.

STATEMENT REGARDING FEDERALLY SPONSORED RESEARCH OR DEVELOPMENT

Not Applicable.

BACKGROUND OF THE INVENTION

This invention relates to an improved drying chamber. While the invention is described with particular reference to its application in x-ray film processors, those skilled in the art will recognize the wider applicability and inventive principals disclosed hereinafter.

X-ray film processors have generally become smaller and more compact than units previously available. These processors all require a plurality of processing stations for processing the film. Film processors of this type are often employed in dentist offices, in order to process x-ray pictures often made of the area to be treated prior to the actual treatment of a patient. A variety of such processors have been developed in the past. These include those described in U.S. Pat. Nos. 4,316,663, 4,086,607 and 5,040,012. In general, these processors includes a first tank containing a developing solution, a second tank for containing a fixer solution, and often include a third tank containing a cleaning solution, generally water, followed by a drying station for drying the processed films, as well as a film transport system for transporting the film through the processing stations and the developed drying station from a film loading point to a film discharge point.

The present invention is particularly concerned with the drying system of the processors. Three methods have been developed through which heat is transferred from one body to another. These include conduction, convection and infrared (IR) radiation. While x-ray film processes in the past have used radiation, infrared radiation per se has not permitted any increase in processor speed.

I have found that efficient infrared drying can occur by paying close attention to the frequency at which the infrared radiation is provided. For example, in the film processor described hereinafter, I have found that the infrared radiation should occur at a frequency that causes the water particles associated with the cleansing operation of the film processor, to resonate. By operating at the infrared heater at a frequency tuned to the material for which evaporation occurs, the water particles, for example, evaporate at higher rates, permitting faster operating times and reduced equipment size.

In addition, I have found that implementation of reflective coatings on the quartz tube that generates the infrared frequency, so as to reflect a higher number of the rays in the direction towards the film, also increases the heat transfer and evaporative capabilities of the processor. Preferably, a reflective coating on the quartz or heater tube that generates the infrared frequency over approximately one-half of the tubes external surface, in combination with the choosing of the tube operating frequency to correspond to the fluid for which evaporation is desired, enables one to increase significantly the speeds of the processor and reduce the film processing time to approximately sixty seconds per film.

BRIEF SUMMARY OF THE INVENTION

One of the objects of this invention is to provide an improved drying plenum.

Another object of this invention is to provide a drying plenum in which infrared frequency is tuned to the material or fluid for which evaporative drying is sought.

Another object of this invention is to provide an improved x-ray film processor.

Another object of this invention is to provide a film processor in which increased film speeds and improved drying times are obtained.

Other objects of this invention will be apparent to those skilled in the art in light of the following description and accompanying drawings.

In accordance with this invention, generally stated, a drying chamber or plenum defines a path for transferring a material to be dried. At least one and preferably a pair of infrared heaters are positioned to divert IR rays toward the material to be dried. A control circuit for driving the heater also is provided, the control circuit operating the heater at a frequency that makes the fluid to be dried resonate. Preferably, a reflective coating on the heater also is employed to direct infrared energy towards the material being dried.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, al ternatives and uses of the invention, including what I presently believe is the best mode of carrying out the invention.

Figure 1:
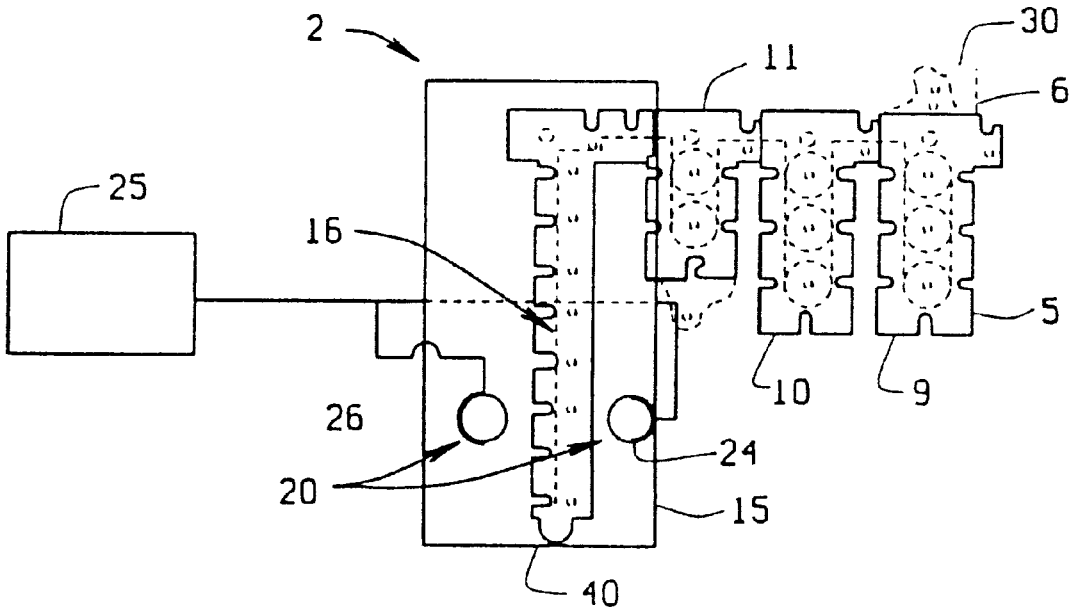
FIG. 1 is a diagrammatic view of an x-ray film processor employing the drying chamber of the present invention.

Referring now to FIG. 1, reference numeral 1 indicates a film processor 1 having a plenum 2 of the p resent invention associated with it.

In general, the film processor 1 includes a transport system 5 for transporting a film 6 through a series of containers for processing the film, and through the plenum 2.

The film processor 1 includes a first tank 9 for containing a fluid solution (typically the developer solution), a second tank 10 for containing a second solution (typically the fixer), and a third tank 11 for containing a cleaning solution (typically water). The tanks 9, 10 and 11 are conventional, and any of a variety of transport system 5 and devices for defining the tanks 9–11 may be employed. For example, the roller tank system as described in U.S. Pat. No. 5,182,593 the specification of which is incorporated herein by reference may be used in some embodiments of the present invention. In any event, the plenum 2 includes an enclosure 15. The transport system 5 defines a travel path 16 for the film.

In the embodiment illustrated, a pair of infrared heaters or tubes 20 are positioned on opposite sides of the path 16, generally spaced 180° from each other. Other mounting arrangements and positions are compatible with the broader aspects of this invention. The infrared heaters 20 are driven by a control system 25.

Control system 25 is conventional in that any common electrical system for driving the heaters 20 may be employed. The control system 25 varies, however, from prior art systems in that the operating point of the IR heaters 20 is specifically chosen or tuned to the particular moisture for which the plenum 2 is provided for evaporation or drying. Thus, the system 25 drives the heater 20 so as to cause the moisture particles to resonate or vibrate, thereby raising the heat transferred to the particles and causing them to evaporate at higher rates. I found that with a water bath commonly employed in the processor 1, a frequency of approximately three microns makes water particles resonate and evaporate at high rates. As will be appreciated by those skilled in art, if one knows the particular fluid for which evaporation is desired, the control device 20 may be specifically designed to drive the IR heaters 20 so that the heaters generate the desired infrared frequency. In the alternative, the control 25 may be adjustable so that the frequencies at which the infrared heaters 20 are driven may be varied to permit to tuning of the heaters after a plenum 2 installation, so that the plenum 2 may be operated efficiently for the particular fluid for which high evaporation rates available with the present invention, is desired.

Figure 2:
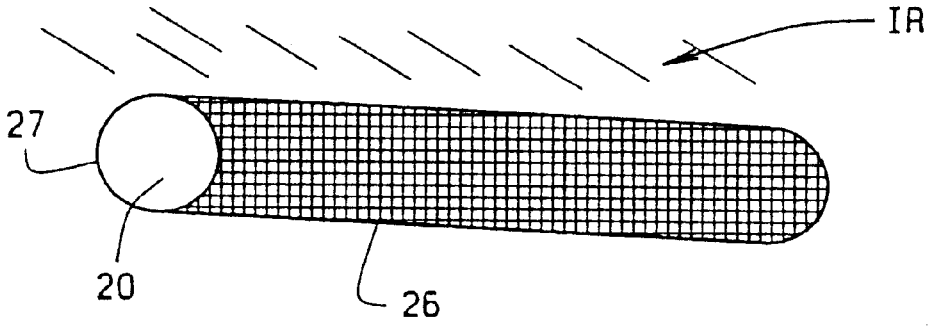
FIG. 2 is a diagrammatic view of one illustrative embodiment of the infrared source employed with the drying chamber of FIG. 1.

While I have found that tuning the infrared frequency to the fluid for which evaporation is desired greatly increases the efficiency of the plenum 1, additional efficiencies can be obtained by also incorporating improvements in the design of the heaters 20. Referring now to FIG. 2, a heater 20 is diagrammatic shown as including a reflective coating 26. The reflective coating 26 generally is intended to cover approximately one-half of the surface area of the heater 20. The non-reflective portion 27 of the heater 20 is positioned so that the infrared rays are directed toward the path 16 in the plenum 16. I have found that the best operation of the plenum 2 is obtained when a reflective gold coating of suitable thickness is positioned on the outer surface of the heater 20. Gold reflects a high percentage of infrared rays back towards the film, instead of permitting those rays to escape through the plenum walls.

Operation of the processor 1 is conventional in that an operator inserts film on an input side 30 of the path 16, and removes processed film on an output side 40 of the path 16. Because of the improved efficiencies obtained with my invention, the plenum 2 size can be reduced, the number of heaters employed may be reduced. Generally, only a single heater 20 is required for same application. However, in the case of the processor shown in the preferred embodiment two of the heaters 20, are located to disable the heater 20 to dry both sides of the film. As indicated, processing time is substantially reduced for a film processor 1 that is of desk top size.

Numerous variations within the scope of the appended claims will be apparent to those skilled in the art and allotted by the foregoing description and accompanying. For example, other reflective coatings may be employed with the heaters 20, if desired. Likewise, the design of the conventional film processing portion of the device 1 may be altered. While roller tanks were described as a one system for the fluid tanks, other embodiments of the invention may employ actual separate containers for the film processing fluids. The enclosure for the apparatus I may vary, and any aesthetically pleasing design suitable for its intended purpose may be utilized. These variations are merely illustrative.

What is claimed is:

1. In an x-ray film processor having:

(a) a first tank for containing a developer solution;

(b) a second tank for containing a fixer solution; and (c) a fluid tank for containing a cleaning solution, the improvement which comprises a plenum drying chamber, said chamber including at least one infrared heating assembly, the assembly including an infrared heater source of radiation, and a control circuit for electrically driving the heater, the control circuit operating to drive the heater to produce radiation at a frequency to cause particles of the fluid for which drying is intended to resonate.

2. The improvement of claim 1 wherein the cleaning fluid is water.

3. The improvement of claim 2 wherein the infrared frequency at which the heaters are driven is three microns.

4. The improvement of claim 1 wherein the heater has a reflective coating for directing infrared energy along a preselected direction.

5. The improvement of claim 4 wherein the reflective coating is gold.

6. The improvement of claim 5 wherein a pair of heaters are positioned so that x-ray film being processed passes between them.

7. A drying chamber comprising:

a path for transferring a material to be dried, said material having a first side and a second side and having a fluid to be dried associated with it;

a pair of infrared heaters positioned along said path so that the material to be dried is exposed to said heaters along both the first side and the second side of the said material;

a control circuit for driving said heaters, said control circuit being adjustable and adapted to drive said heaters at a frequency that makes the fluid to be dried resonate; and a reflective coating on said heaters adapted to direct the infrared energy toward said material.

8. The chamber of claim 7 wherein said fluid is water and the infrared frequency is approximately three microns.

9. The chamber of claim 8 wherein said reflective coating is gold.

10. The drying chamber of claim 9 adapted for use in an x-ray film processor, wherein the material being dried is x-ray film.

11. A drying chamber, comprising:

a path for transferring a material to be dried, said material having a first side and a second side, and having fluid to be dried associated with at least one of said first and second sides;

at least one infrared heater assembly, said assembly including an infrared heater source of radiation, and a control circuit operatively connected to said heater, the control circuit being adjustable to drive the heater at a frequency to produce radiation from the heater at a predetermined frequency with frequency causing particles of the fluid to resonate during the drying operation, a reflective coating positioned about said heater so as to direct the infrared energy toward said material.

12. The drying chamber of claim 11 wherein the fluid is water.

13. The drying chamber of claim 12 wherein the infrared frequency at which the heater is driven is three microns.

14. The drying chamber of claim 13 wherein the reflective coating is gold.

15. The drying chamber of claim 14, further including a second infrared heating assembly, the second assembly including an infrared heater source of radiation, and a control circuit operatively connected to said heater, the control circuit driving the heater so as to produce radiation therefrom.

16. The drying chamber of claim 14 wherein the heater assemblies are positioned so that the material being processed passes between the infrared heaters.

17. The drying chamber of claim 16 adapted for use in an x-ray film processor, the material being processed comprising x-ray film.

* * * * *